US008303744B2

(12) United States Patent
Bradford

(10) Patent No.: US 8,303,744 B2
(45) Date of Patent: Nov. 6, 2012

(54) METHOD OF MAKING MULTILAYER PRODUCT HAVING HONEYCOMB CORE

(75) Inventor: Judson A. Bradford, Holland, MI (US)

(73) Assignee: Bradford Company, Holland, MI (US)

( * ) Notice: Subject to any disclaimer, the term of this patent is extended or adjusted under 35 U.S.C. 154(b) by 147 days.

(21) Appl. No.: 13/024,838

(22) Filed: Feb. 10, 2011

(65) Prior Publication Data

US 2012/0205035 A1 Aug. 16, 2012

(51) Int. Cl.
*B31D 3/02* (2006.01)

(52) U.S. Cl. ..... 156/201; 156/204; 156/210; 156/252; 156/257; 264/145; 264/152

(58) Field of Classification Search ..... None
See application file for complete search history.

(56) References Cited

U.S. PATENT DOCUMENTS

| | | | |
|---|---|---|---|
| 2,668,327 | A | 2/1954 | Steele |
| 3,037,592 | A | 6/1962 | Shipley et al. |
| 3,684,618 | A | 8/1972 | Geschwender |
| 4,197,341 | A | 4/1980 | Rule |
| 5,132,156 | A | 7/1992 | Trassare, Jr. et al. |
| 5,252,163 | A | 10/1993 | Fell |
| 5,389,059 | A | 2/1995 | Corwin |
| 6,183,836 | B1 | 2/2001 | Pflug |
| 6,726,974 | B1 | 4/2004 | Pflug et al. |
| 6,800,351 | B1 | 10/2004 | Pflug et al. |
| 2008/0131654 | A1 | 6/2008 | Bradford et al. |
| 2008/0176027 | A1 | 7/2008 | Pflug et al. |
| 2008/0202672 | A1 * | 8/2008 | Bradford ..... 156/210 |

FOREIGN PATENT DOCUMENTS

| | | |
|---|---|---|
| DE | 19716637 | 10/1998 |
| FR | 1509018 | 1/1968 |
| JP | 56150534 A * | 11/1981 |
| WO | 97/03816 | 2/1997 |
| WO | 2006/053407 | 5/2006 |

OTHER PUBLICATIONS

Pflug, Jochen, Project Page, "Composite Materials Group", K.U. Leuven Dept. MTM, Maschinenfabrik Meyer (no date), 1 page.
Pflug, Jochen et al, "Continuously Produced Honeycomb Cores", K.U. Leuven Dept. MTM, (no date), 10 pages.
"Composite Materials Group", "TorHex Projects", http://www.mtm.kuleuven.ac.be/Research/C2/poly/TRHex.htm, (2004), 6 pages.

(Continued)

*Primary Examiner* — Barbara J. Musser
(74) *Attorney, Agent, or Firm* — Wood, Herron & Evans, LLP

(57) ABSTRACT

A process of making a multilayered product having an interior honeycomb layer or core. The interior layer is formed by passing a generally flat web of material between rollers to create a corrugated web. The corrugated web is cut and folded to create the honeycomb core. Outer protective skins are applied to exterior surfaces of the interior layer to create a multilayered material which is then cut to size.

10 Claims, 9 Drawing Sheets

OTHER PUBLICATIONS

Pflug, Jochen et al, Thermoplastic Folded Honeycomb Cores—Cost Efficient Production of All Thermoplastic Sandwich Panels, K.U. Leuven, Dept. Mechanical Engineering, (no date), 8 pages.

Eureka EU 1440 Factory, "E! 2796 Factory Thermhex—New Thermoplastic Honeycomb Sandwich Core Materials for Structural Applications", http://www.kp.dir.de/EUREKA/FACTORY/publications.htm, (Sep. 9, 2005), 6 pages.

Pflug, Jochen et al, "Folded Honeycomb Cardboard and Core Materials for Structural Applications", Sandwich Construction 5, (c) EMAS 1999, 12 pages.

Pflug, Jochen et al., "New Sandwich Material Concepts—Continuously Produced Honeycomb Cores", Composites in Transport Network, K.U. Leuven, Dept. MTM, Oct. 2, 2003, 32 pages.

* cited by examiner

METHOD OF MAKING MULTILAYER PRODUCT HAVING HONEYCOMB CORE

FIELD OF THE INVENTION

This invention relates generally to a product for structural, packaging, and other applications and the process of making the product.

BACKGROUND OF THE INVENTION

In the aerospace industry, honeycomb products have been used as a core component for sandwich panels and boards that are resistant to buckling and bending. These honeycomb products each comprise a plurality of cells, which in cross-section have a generally hexagonal shape. Such products may be fabricated from aluminum, fiber paper or plastic, among other materials. A sandwich structure may be prepared having two cover layers or skins which are welded, adhesively bonded or otherwise secured to the honeycomb product to create a multilayered or multi-laminate material. Interest expressed in other industrial sectors concerning the use of lightweight sandwich structures is continually growing, due at least in part to the realization of its high strength properties while maintaining a relatively low structural weight per volume of product.

A multilayered or multi-laminate material having a honeycomb product as the core thereof may be used in the packaging industry. However, in automobile part packaging and comparable markets, such a product must compete with corrugated paperboard or corrugated plastic or like materials which may be produced quickly and relatively inexpensively.

U.S. Pat. No. 6,183,836 discloses a honeycomb core for use in a sandwich material in which the material of the honeycomb core is cut and then folded to create a plurality of hexagonal cells. Due to the process used to make the honeycomb product, including the complex folding of the cut sheet, the resultant structure may be expensive to manufacture.

A process for producing a folded honeycomb core for use in sandwich materials from a continuous uncut web is disclosed in U.S. Pat. No. 6,726,974. U.S. Pat. No. 6,800,351 discloses another process for producing a folded honeycomb core which includes scoring a corrugated material before rotating interconnected corrugated strips. The honeycomb core resulting from using either of these methods may have material which adds to the weight of the honeycomb core, but may not significantly improve the strength of the honeycomb core.

Regardless of which method is used to manufacture a honeycomb core, the resultant core may have a compressive strength in one direction which is higher than the compressive strength in another direction. Often the compressive strength in one direction is higher due to several layers of the material being overlapped; all the overlapped portions extending in the same direction. Accordingly, there is a need for a multilayered product which has an interior honeycomb layer having equal strengths in multiple directions.

There is further a need for a process for manufacturing a product, such as a honeycomb product, for use in a multilayered material which is less expensive and more efficient than heretofore known processes.

SUMMARY OF THE INVENTION

The present invention comprises a process for producing a sandwich-like or multilayered product having an interior layer, including a honeycomb core and the resultant product.

The product may have any number of layers; the product is not intended to be limited to three layers. The processes of the present invention may be used to make products for use in any desired environment or industry, including but not limited to, packaging materials.

According to one aspect of this invention, a process of making a multilayered product comprises moving a generally planar web of material in a first direction. The generally planar or generally flat web of material may be unrolled from a roll of material before being treated. The web or webs may be heated to any desired temperature and be any desired thickness at the start of the process and at any stage in the process. In addition, the web or webs may be any desired material including, but not limited to, plastic.

The next step comprises passing the generally planar web of material between a pair of rollers to produce a generally corrugated web of material having a generally corrugated profile with continuous flattened peaks and flattened valleys joined by connecting portions of the web, the flattened peaks and flattened valleys extending in the first direction or direction of travel of the web. Additional steps comprise cutting the continuous corrugations of the corrugated web and then folding the cut corrugated web to create a honeycomb core. Another step comprises applying or securing outer skins to the honeycomb core. In order to obtain a product of a desired size, the last step in the process may comprise cutting the multilayered material, including the honeycomb core and the outer skins to create the finished product.

According to another aspect of the invention, the process comprises making a multilayered product, including an interior layer having a honeycomb core. The process includes applying outer skins to the interior layer and cutting the combined layers to a desired size. The process of making the interior layer comprises moving a generally flat web of material in a first direction. The next step comprises passing the web of material between rollers to produce a corrugated web of material having a generally corrugated profile with continuous flattened peaks and flattened valleys joined by connecting portions of the web, the flattened peaks and flattened valleys extending in the direction of travel of the web. The next step in the process comprises cutting the continuous corrugations of the corrugated web. The next step in the process comprises folding the corrugated web to create a honeycomb core. Another step in the process comprises applying outer skins to the honeycomb core.

According to another aspect of the invention, the process comprises making a multilayered product, including an interior layer having a honeycomb core. One step in the process comprises passing a web of material between rollers to produce a corrugated web of material having continuous flattened peaks and flattened valleys joined by connecting portions of the web. The flattened peaks and flattened valleys extend in the direction of travel of the web. Another step in the process comprises cutting portions of the corrugated web. Another step in the process comprises folding the corrugated web to create a honeycomb core. Another step in the process comprises applying outer skins to the honeycomb core.

According to another aspect of the invention, the rollers are shaped so that some of the connecting portions of the continuous corrugations are thicker than the peaks or valleys of the continuous corrugations due to the configurations of the rollers. Alternatively or additionally, some of the connecting portions of the continuous corrugations are thicker than other of the connecting portions of the continuous corrugations due to the configurations of the rollers.

Regardless of the method used to create the multilayered product, one advantage of the process is that a lightweight, strong product having a large strength-to-weight ratio may be quickly and easily manufactured in a desired size or height. The product of this invention, which may be produced according to any of the processes described herein, has a relatively high strength-to-weight ratio, and may be made from many different materials quickly and inexpensively. The strength-to-weight ratio may be improved by strategic removal of material from the web at some time in the process of fabricating the product. The multilayered product may be incorporated into any desired product, or used in any desired manner.

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
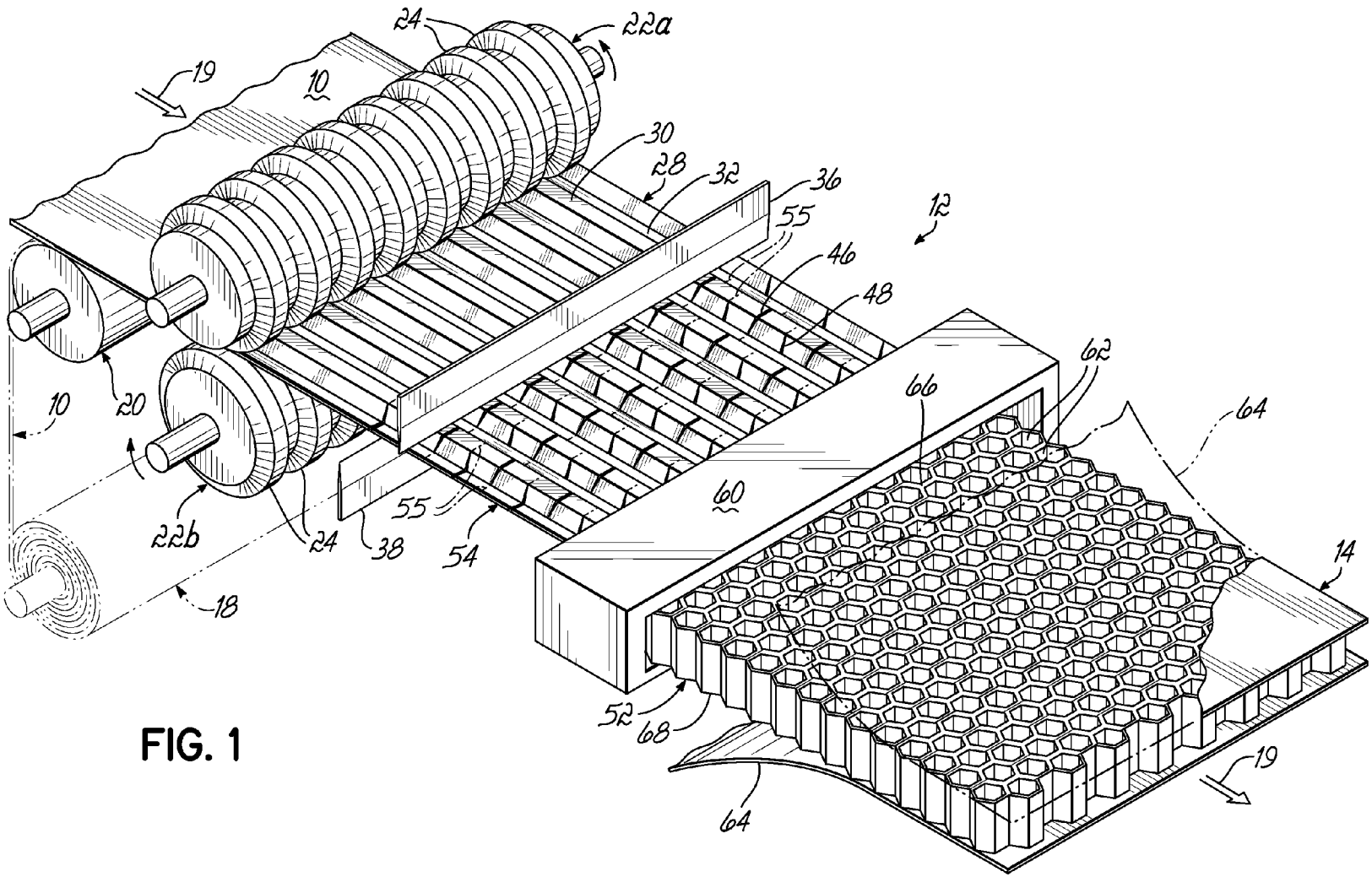
FIG. 1 is a perspective view of a generally planar web of material being passed between rollers, cut and folded into a honeycomb core before being covered with outer skins.
Figure 12:
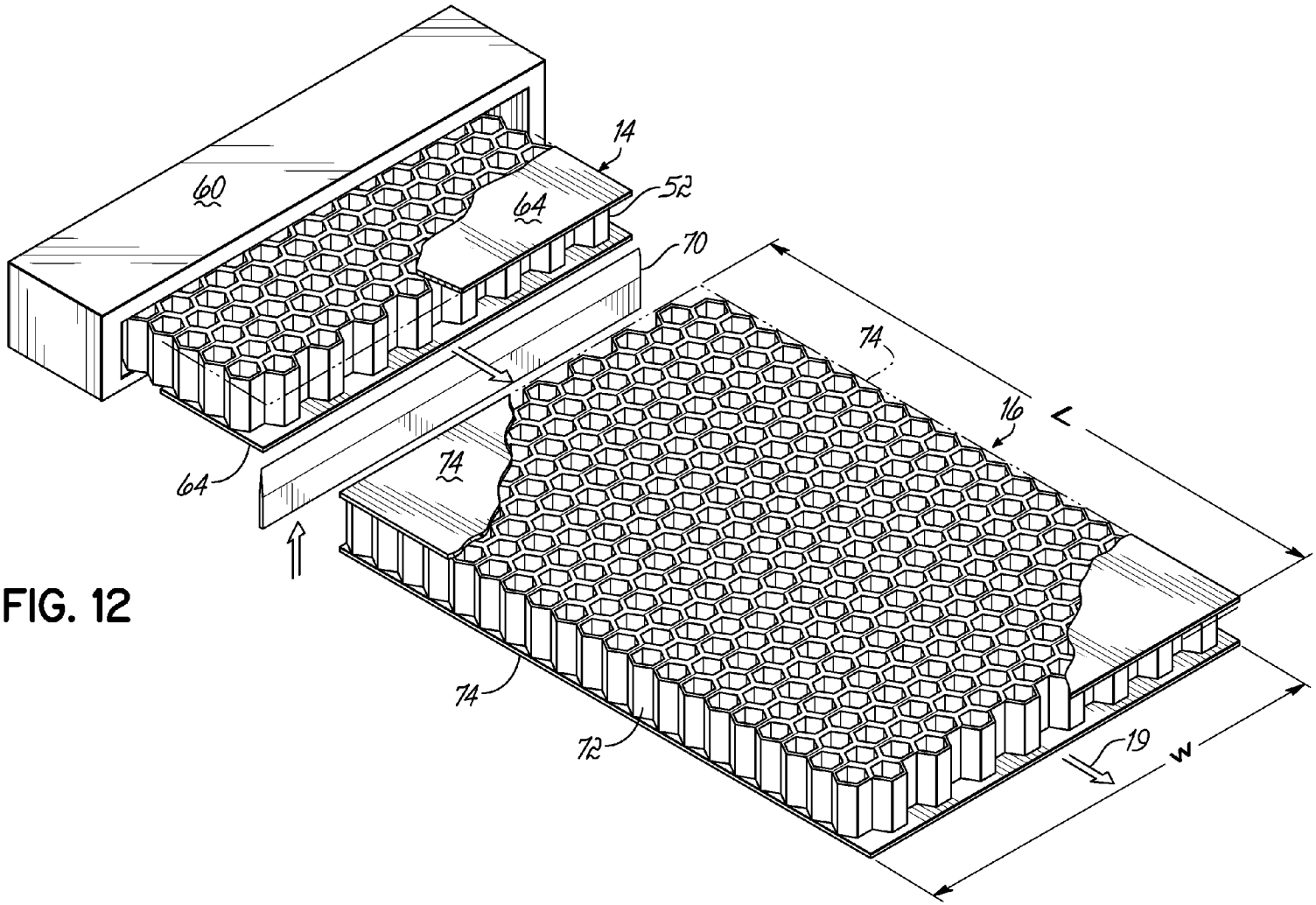
FIG. 12 is a perspective view of a continuous flow of multilayered product having a honeycomb core being cut to a desired size.

Referring to the drawings and, particularly to FIG. 1, a flexible web of material 10 is shown entering an apparatus 12 for producing a continuous flow of multilayered material 14 which is cut to size to produce a finished multilayered product 16 (see FIG. 12). The web of material 10 may come from any source including, but not limited to a roll 18 shown in phantom in FIG. 1. Once unwound or unrolled, the web of material 10 is generally planar or flat. It is then pulled or moved in the direction of arrows 19 in any conventional manner, including being helped by a rotational, moving roller 20. The direction of travel of the web 10 during the process of the present invention is indicated by arrows 19 shown in FIG. 1. Although only one moving roller 20 is shown in FIG. 1, the web 10 may pass around or between several rollers before being treated or deformed by shaping rollers 22*a*, 22*b*, shown in detail in FIG. 2, into a corrugated shape as described below.

The flexible web of material 10 may be solid or may have openings formed therethrough at any stage in the process, as illustrated and/or described in U.S. patent application Ser. No. 11/535,623, which is fully incorporated herein.

Figure 2:
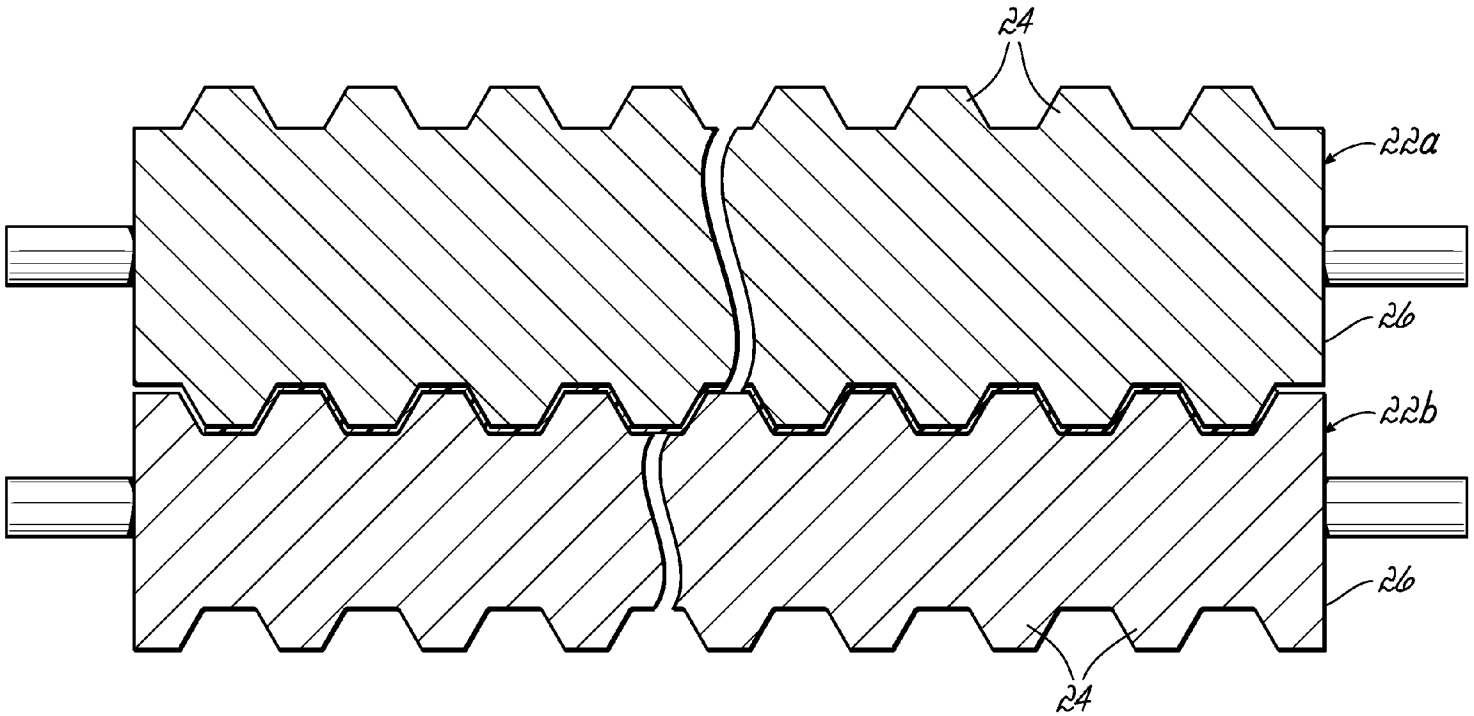
FIG. 2 is a cross-sectional view of the rollers of FIG. 1, the flat web of material of FIG. 1 passing therebetween.

The next step in the process shown in FIGS. 1 and 2 is to plastically deform or treat the web of material 10 by passing the web of material 10 between rotational shaping rollers 22*a*, 22*b* which may be cooled or heated to any desired temperature. Alternatively, the moving relatively flat web of material 10 may be heated before being plastically deformed via the shaping rollers 22*a*, 22*b*.

Figure 3:
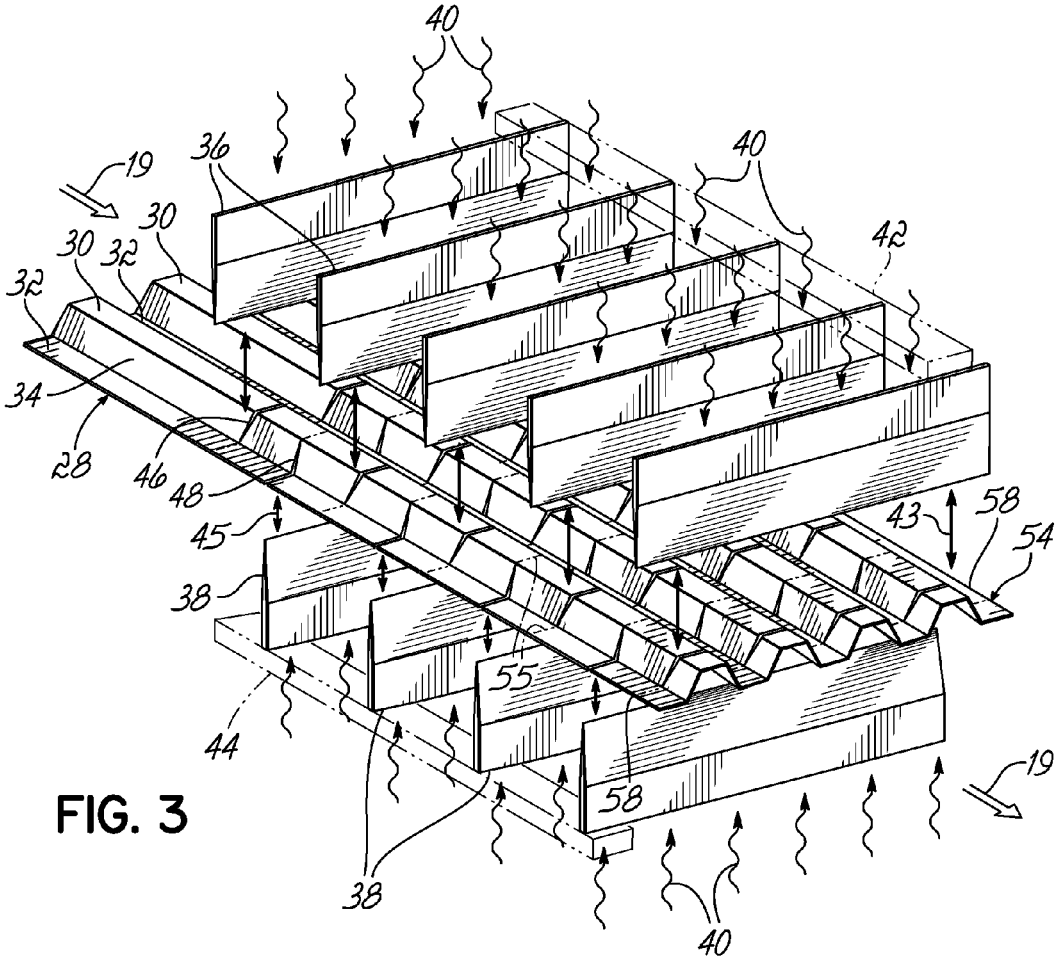
FIG. 3 is a perspective view of a corrugated web being cut in accordance with the present invention.

As shown in FIG. 2, each shaping roller 22*a*, 22*b* has a plurality of teeth 24 extending outwardly from a core 26 of the shaping roller. The configuration or shape of these teeth 24 imparts a specific configuration to the web 10 passing between the shaping rollers 22*a*, 22*b*. As shown in FIGS. 1 and 3, the treatment or deformation caused by passing the web 10 between the shaping rollers 22*a*, 22*b* creates an uncut generally corrugated web 28 having a generally corrugated profile with continuous flattened peaks 30 and continuous flattened valleys 32 joined by continuous connecting portions 34, all extending in the direction of travel of the web 10 shown by arrows 19. The shaping rollers 20*a*, 20*b* plastically deform or shape the unrolled web of material 10 from a generally flat orientation to a generally corrugated orientation having continuous flattened peaks 30 and continuous flattened valleys 32 joined by continuous connecting portions 34, all extending in the direction of travel of the web 10 shown by arrows 19.

Although the shaping rollers 20*a*, 20*b* are shown as imparting one imprint upon the web 10, other configurations or types of corrugations may be imparted upon the web 10. For example, the uncut corrugated web 28 may have any number of flattened peaks and/or flattened valleys of any desired size, i.e., width.

Figure 2A:
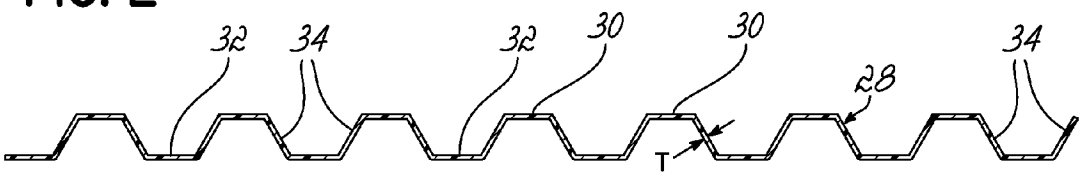
FIG. 2A is a cross-sectional view of a corrugated web of material after passing between the rollers of FIG. 2.

According to one aspect of the present invention, as shown in FIG. 2A, the uncut corrugated web 28 has a uniform thickness along its length and width. In other words, the thickness "T" of the web is identical throughout; the same in the peaks 30, valleys 32 and connecting portions 34. This thickness "T" may be changed by changing the location of the shaping rollers 22*a*, 22*b* so as to change the distance or gap or nip between the teeth 24 of the shaping rollers 22*a*, 22*b*.

As shown in FIGS. 1 and 3, the next step in the process is to cut portions of the uncut corrugated web 28 using upper and lower cutters 36, 38 which may or may not be heated. The drawings show cutters 36, 38 of one particular configuration. As shown in FIG. 3, arrows 40 are used to represent that the cutters 36, 38 may be heated. However, the cutters used in any of the processes of this invention may be other sizes, shapes or configurations and may be moved by any conventional means, such as a pneumatic power drive or any other driver (not shown).

As shown in FIG. 3, the group of upper cutters 36 may be joined together by one or more joiners 42 (one being shown in phantom in FIG. 3) and move together in the direction of arrows 43. In order to cut the generally flattened peaks 30 and the connecting portions 34 of the uncut corrugated web 28, the cutters 36 are moved downwardly, as shown in FIG. 3, a specific distance without cutting the generally flattened valleys 32 of the uncut corrugated web 28.

Similarly, as shown in FIG. 3, the group of lower cutters 38 may be joined together by one or more joiners 44 (one being shown in phantom in FIG. 3) and move together in the direction of arrows 45. In order to cut the generally flattened valleys 32 and the connecting portions 34 of the uncut corrugated web 28, the cutters 38 are moved upwardly, as shown in FIG. 3, a specific distance without cutting the generally flattened peaks 30 of the uncut corrugated web 28. Although the number and size of the cutters 36, 38 of FIGS. 1 and 3 do not equal one another, one skilled in the art may appreciate that any number of cutters of any desired size may be used in accordance with the present invention.

Figure 4:
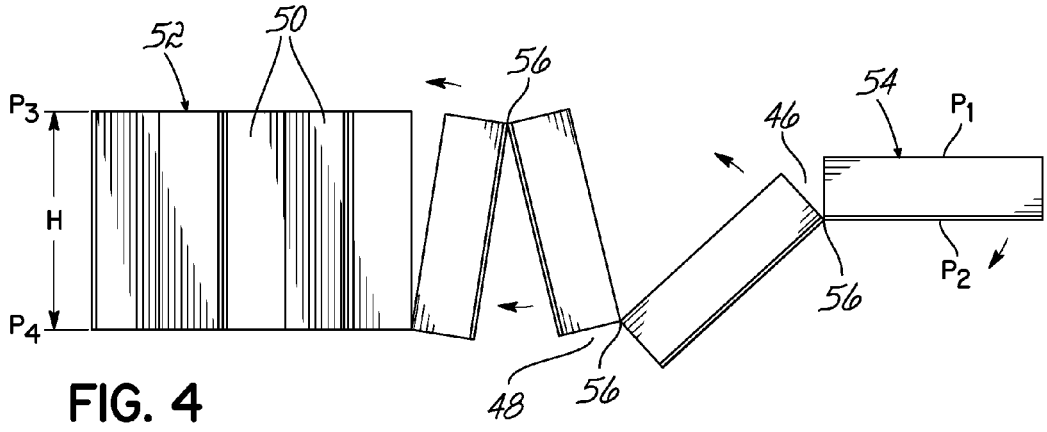
FIG. 4 is a perspective view of the cut corrugated web of FIG. 4 being folded into a honeycomb core.
Figure 5:
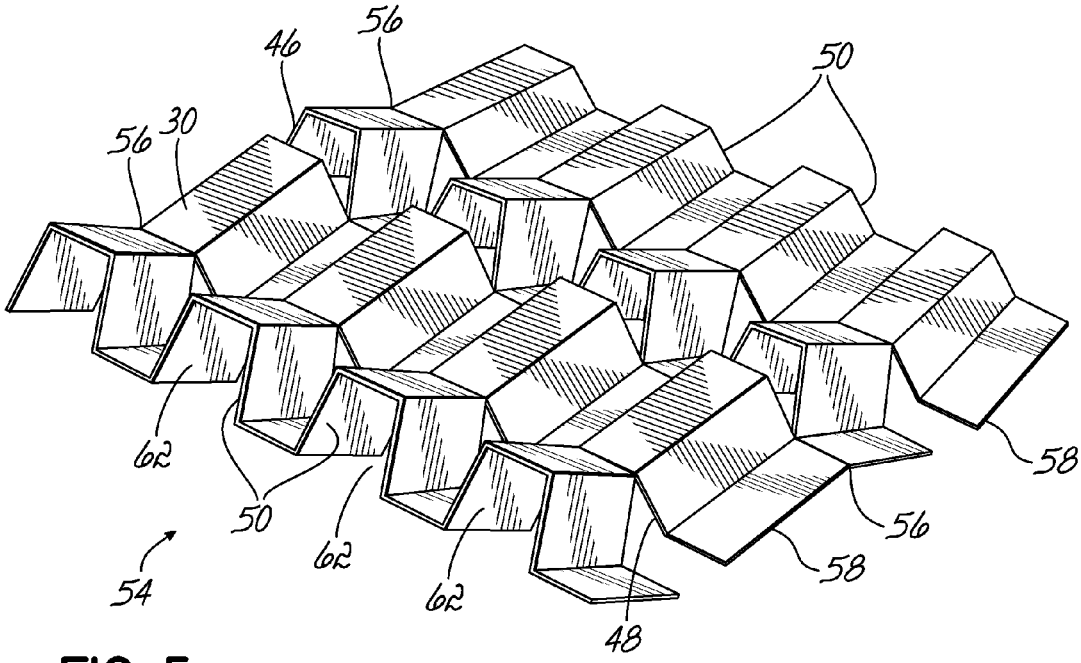
FIG. 5 is an enlarged perspective view of a portion of the cut corrugated web of FIG. 4.

The location of the cutters 36, 38 may be changed to change the distance between the upper cuts 46 made by the upper cutters 36 and the lower cuts 48 made by the lower cutters 38. The distance between adjacent cuts 46, 48 determines the height "H" of the cells 50 of the honeycomb core or layer 52 as shown in FIGS. 4 and 5. As a result of the cutting process shown in FIGS. 1 and 3, a continuous cut corrugated web 54 is formed.

As shown in FIG. 4, the next step in the process is to fold the continuous cut corrugated web 54 along scored portions 55 to create fold lines 56. Each fold line 56 is defined by a plurality of aligned, spaced upper cuts 46 or a plurality of spaced, aligned lower cuts 48 and spaced scored portions 55. If desired, the scored portions 55 may be omitted. Fold lines 56 extend transversely from one side edge 58 of the continuous cut corrugated web 54 to the opposing side edge 58 in a direction generally perpendicular to the direction of travel of the continuous cut corrugated web 54. As shown in FIG. 4, after being folded in an accordion fashion, the continuous cut corrugated web 54 shortens and becomes a continuous honeycomb core or layer 52. The folding step is disclosed schematically by the box 60 in FIGS. 1 and 12.

As shown in FIGS. 4 and 5, the fold lines 56 alternate between the upper and lower planes P1 and P2 of the continuous cut corrugated web 54. The honeycomb core 52 has a height H defined as the distance between the upper and lower planes P3, P4 of the honeycomb core 52 after the continuous cut corrugated web 54 has been folded, as shown in FIGS. 4 and 5. As shown in FIG. 5, each of the cells 50 of the honeycomb core 52 has a hollow interior 62. As shown in FIG. 5, when the continuous cut corrugated web 54 is folded, the touching or contacting portions of the continuous peaks 30 and continuous valleys 32 may be joined together in any known manner.

As shown in FIG. 1, the next step in the process is applying or securing outer skins 64 (one being shown partially in phantom for clarity) to upper and lower surfaces 66, 68 of the continuous honeycomb core 52 in the direction of travel of the web 10. As shown in FIG. 1, this process described above with the steps being performed in any desired order creates a continuous strip of material 14 having a sandwich-like or trilaminate composition, the outer skins 64 being outside and secured to the continuous interior layer 52. The continuous interior layer 52 comprises a honeycomb core made up of honeycomb cells 50, each having a hollow interior 62, which reduces the weight of the final product 16 without compromising the strength of the product 16.

As illustrated in FIG. 12, the continuous multilayered material 14 may be cut to size via a cutter 70 to create a finished product 16 having a honeycomb interior layer. Although one size product 16 is illustrated in FIG. 12, the product 16 may be any desired size, i.e., length, width and/or height.

FIG. 1 shows two outer or protective skins 64 being placed over and under the continuous honeycomb core 52 to create a three-layered continuous product 14. The outer skins 64 may be applied from rolls of material (not shown), or may be supplied in any known manner. The cutter or cutting device 70 cuts the three-layered continuous product 14 to a desired size having a longitudinal dimension or length L in the direction of travel of the materials and a transverse dimension or width W perpendicular to the direction of travel of the materials, as shown in FIG. 12. The result is a finished product 16 having a honeycomb interior layer 72 and outer skins 74. Alternatively, the three-layered continuous product 14 may be rolled up and later cut to obtain products of desired sizes. This process enables the product 16 to weigh less than comparable products having a solid honeycomb core without compromising strength or integrity.

Figure 6:
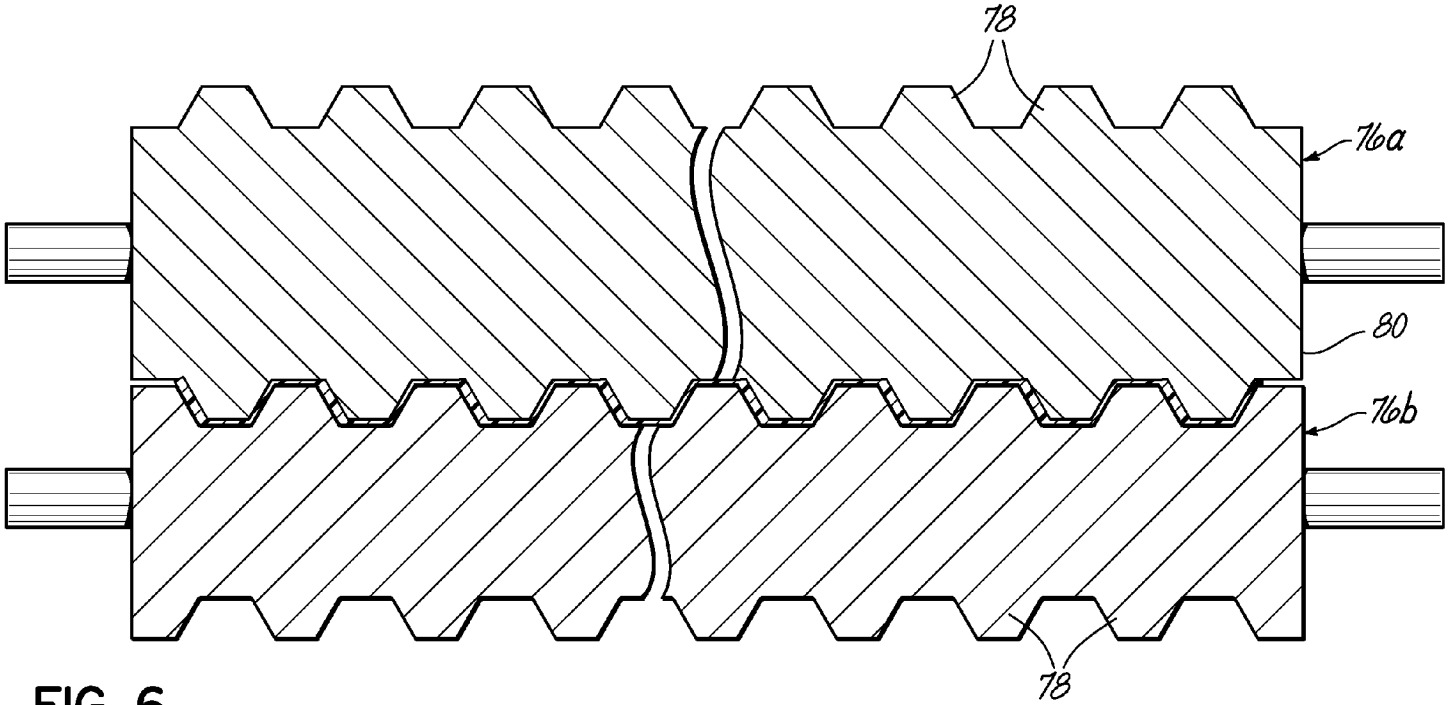
FIG. 6 is a cross-sectional view of alternative rollers, a flat web of material passing therebetween for making a honeycomb core according to another aspect of the present invention.
Figure 7:
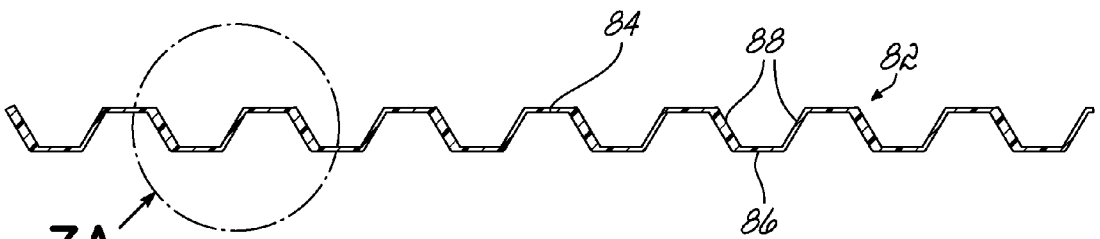
FIG. 7 is a cross-sectional view of a corrugated web of material after passing between the rollers of FIG. 6.
Figure 8:
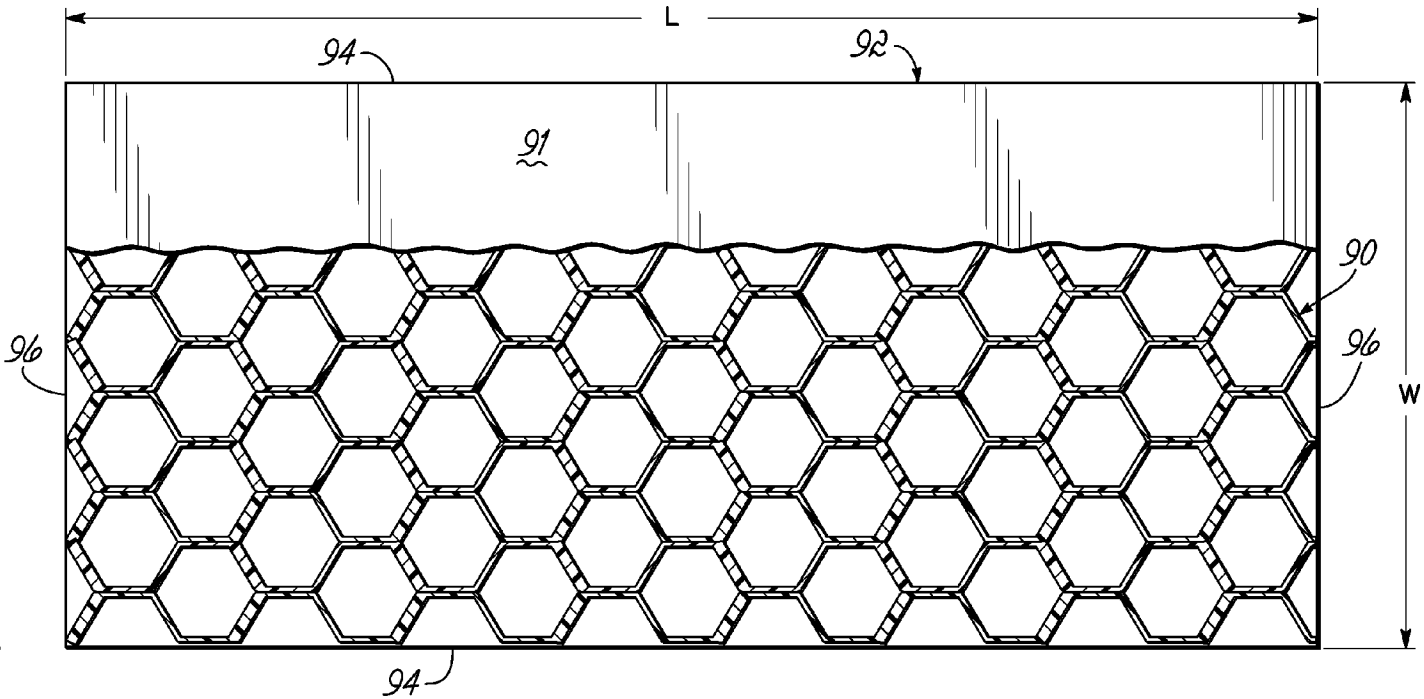
FIG. 8 is a top plan view, partially cut away, of a product made using the honeycomb core of FIGS. 7 and 7A.

FIGS. 6-8 illustrate another aspect of the present invention. FIG. 6 illustrates alternative shaping rollers 76*a*, 76*b* used in the process shown herein and described above. Shaping rollers 76*a*, 76*b*, like shaping rollers 22*a*, 22*b*, function to plastically deform, treat or shape a relatively flat web of material 10 by passing the web of material 10 between the rotational shaping rollers 76*a*, 76*b*. The rotational shaping rollers 76*a*, 76*b* may be cooled or heated to any desired temperature. Alternatively or additionally, the moving relatively flat web of material 10 may be heated before being plastically deformed via the shaping rollers 76*a*, 76*b*.

As shown in FIG. 6, each shaping roller 76*a*, 76*b* has a plurality of teeth 78 extending outwardly from a core 80 of the shaping roller. The configuration or shape of these teeth 78 imparts a specific configuration to the web 10 passing between the shaping rollers 76*a*, 76*b*. As shown in FIGS. 6 and 7, the treatment or deformation caused by passing the web 10 between the shaping rollers 76*a*, 76*b* creates a continuous uncut generally corrugated web 82 shown in FIGS. 7 and 7A having a generally corrugated profile with continuous flattened peaks 84 and continuous flattened valleys 86 joined by continuous connecting portions 88, all extending in the direction of travel of the web 10 shown by arrows 19 in FIG. 1. The shaping rollers 76*a*, 76*b* plastically deform or shape the moving web of material 10 from a generally flat orientation to a generally corrugated orientation having continuous flattened peaks 84 and continuous flattened valleys 86 joined by continuous connecting portions 88, all extending in the direction of travel of the web 10.

Although the shaping rollers 76*a*, 76*b* are shown as imparting one imprint upon the web 10, other configurations or types of corrugations may be imparted upon the web 10 by these shaping rollers. For example, the uncut corrugated web 82 may have any number of flattened peaks and/or flattened valleys of any desired size.

Figure 7A:
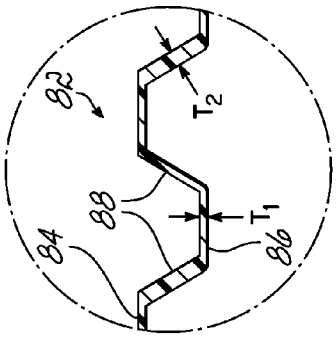
FIG. 7A is an enlarged view of the encircled area of FIG. 7.

As shown in FIGS. 7 and 7A, the uncut corrugated web 82, after having passed between the rotational shaping rollers 76*a*, 76*b*, does not have a uniform thickness. As shown in FIG. 7A, the thickness "$T_1$" of the flattened peaks 84 and flattened valleys 86 of the corrugated web 82 is identical. However, the thickness "$T_2$" of alternative connecting portions 88 of the corrugated web 82 is larger or greater than the thickness "$T_1$" of the flattened peaks 84 and flattened valleys 86 of the corrugated web 82. These thicknesses may be changed by changing the location of the shaping rollers 76*a*, 76*b* so as to change the distance or gap or nip between the teeth 78 of the shaping rollers 76*a*, 76*b*. However, even though the distance or gap or nip between the teeth 78 of the shaping rollers 76*a*, 76*b* is changed, every other one of the connecting portions is thicker than the peaks and valleys of the generally corrugated web 82, according to this aspect of the invention.

FIG. 8 illustrates a finished multilayered product 92 made in accordance with this aspect of the invention (after the corrugated web 82 shown in FIG. 7 is folded). Multilayered product 92 has a pair of opposed side edges 94, the distance between which defines the width "W" of the multilayered product 92. Similarly, multilayered product 92 has a pair of end edges 96, the distance between which defines the length "L" of the product 92. The multilayered product 92 has a middle layer or honeycomb core 90 covered on top and bottom with outer or protective skins or layers 91 (only one being partially shown in FIG. 8).

One of the results of having one of the connecting portions 88 of the corrugated web 82 thicker than the peaks 84 and valleys 86 of the corrugated web 82 (shown in FIG. 7A) is that the strength of the honeycomb core 90 of product 92 shown in FIG. 8 is the same in the transverse (between opposed side edges 94) and longitudinal (between opposed end edges 96) directions. As shown in FIG. 7A, because the thickness "$T_2$" of alternative connecting portions 88 of the corrugated web 82 is approximately the same as the thickness of two peaks 84 or valleys 86 of the corrugated web 82 contacting each other, after the process of manufacturing multilayered product 92 is complete, the strength of the honeycomb core 90 of product 92 is the same in both the transverse and longitudinal directions.

Figure 9:
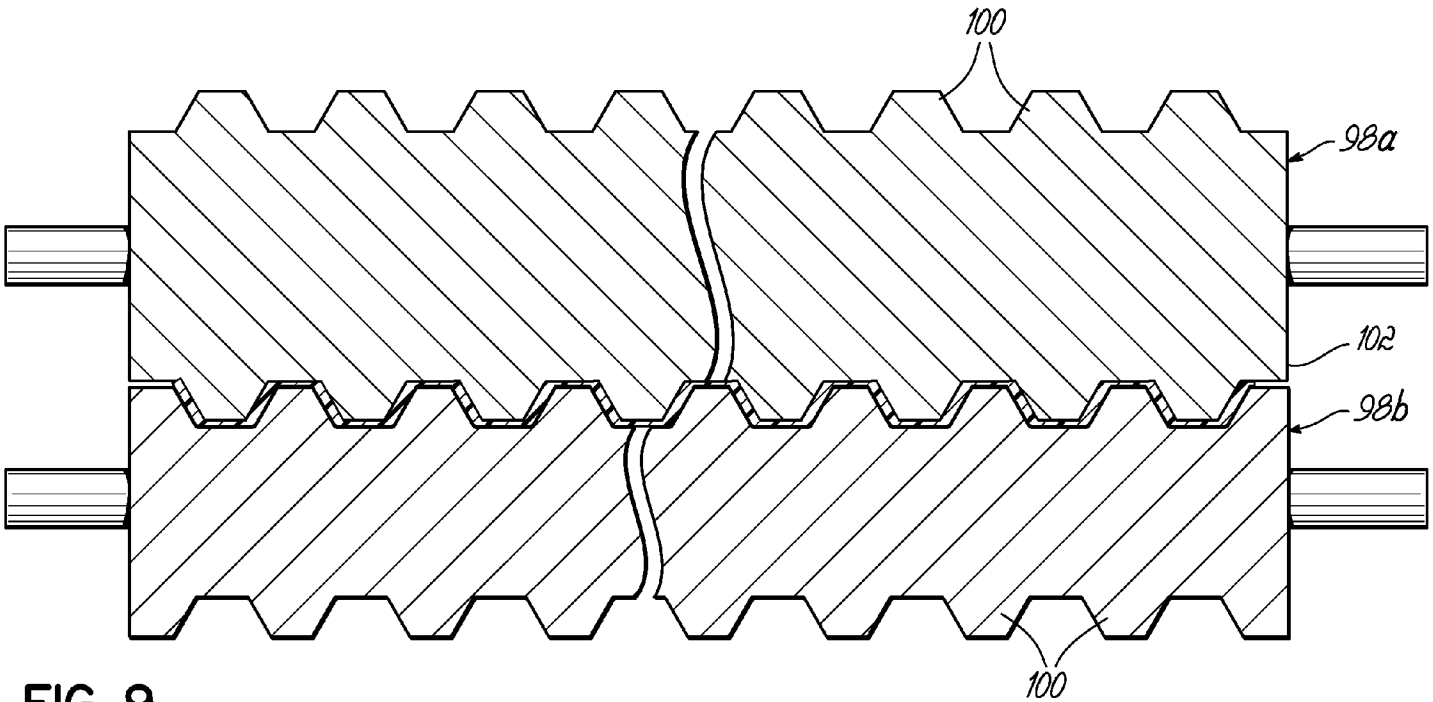
FIG. 9 is a cross-sectional view of alternative rollers, a flat web of material passing therebetween for making a honeycomb core according to another aspect of the present invention.
Figure 10:
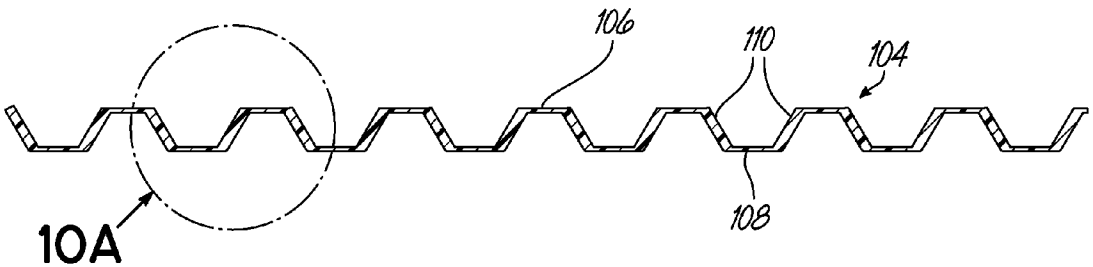
FIG. 10 is a cross-sectional view of a corrugated web of material after passing between the rollers of FIG. 9.
Figure 11:
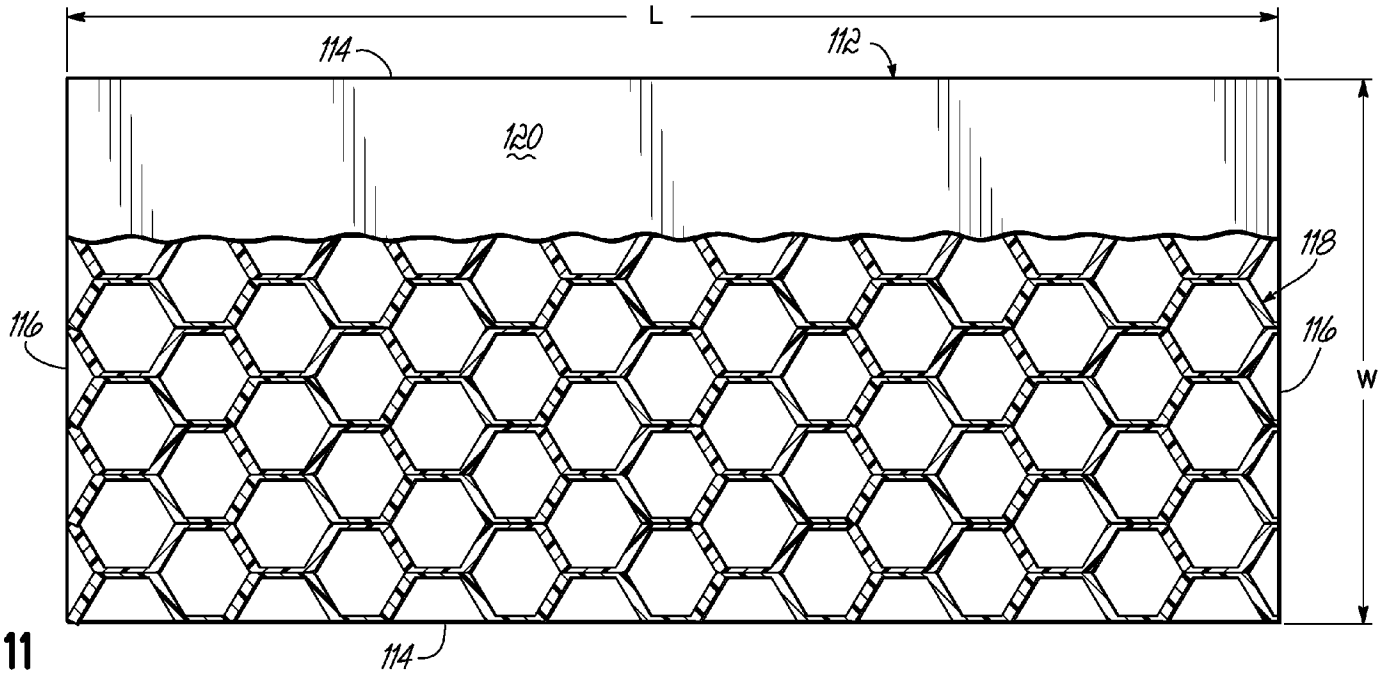
FIG. 11 is a top plan view, partially cut away, of a product made using the honeycomb core of FIGS. 10 and 10A.

FIGS. 9-11 illustrate another aspect of the present invention. FIG. 9 illustrates alternative shaping rollers 98*a*, 98*b* used in the process shown and described herein. Shaping rollers 98*a*, 98*b*, like shaping rollers 22*a*, 22*b* and 76*a*, 76*b*, function to plastically deform, treat or shape a relatively flat web of material 10 by passing the web of material 10 between the rotational shaping rollers 98*a*, 98*b*. The rotational shaping rollers 98*a*, 98*b* may be cooled or heated to any desired temperature. Alternatively or additionally, the moving relatively flat web of material 10 may be heated before being plastically deformed via the shaping rollers 98*a*, 98*b*.

As shown in FIG. 9, each shaping roller 98*a*, 98*b* has a plurality of teeth 100 extending outwardly from a core 102 of the shaping roller. The configuration or shape of these teeth 100 imparts a specific configuration to the web 10 passing between the shaping rollers 98*a*, 98*b*. As shown in FIGS. 9 and 10, the treatment or deformation caused by passing a relatively flat web between the shaping rollers 98*a*, 98*b* creates a continuous, uncut generally corrugated web 104 shown in FIGS. 10 and 10A having a generally corrugated profile with continuous flattened peaks 106 and continuous flattened valleys 108 joined by continuous connecting portions 110, all extending in the direction of travel of the web 10 shown by arrows 19 in FIG. 1. The shaping rollers 98*a*, 98*b* plastically deform or shape the moving web of material 10 from a generally flat orientation to a generally corrugated orientation having continuous flattened peaks 106 and continuous flattened valleys 108 joined by continuous connecting portions 110, all extending in the direction of travel of the web 10.

Although the shaping rollers 98*a*, 98*b* are shown as imparting one imprint upon the web 10, other configurations or types of corrugations may be imparted upon the web 10 by these shaping rollers. For example, the uncut corrugated web 82 may have any number of flattened peaks and/or flattened valleys of any desired size.

Figure 10A:
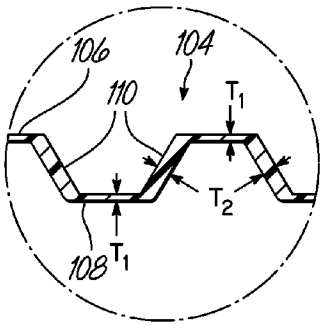
FIG. 10A is an enlarged view of the encircled area of FIG. 10.

As shown in FIGS. 10 and 10A, the uncut corrugated web 104, after having passed between the rotational shaping rollers 98*a*, 98*b*, does not have a uniform thickness. As shown in FIG. 10A, the thickness "$T_1$" of the flattened peaks 106 and flattened valleys 108 of the corrugated web 104 is identical. However, the thickness "$T_2$" of each connecting portion 110 of the corrugated web 104 is larger or greater than the thickness "$T_1$" of the flattened peaks 106 and flattened valleys 108 of the corrugated web 104. These thicknesses may be changed by changing the location of the shaping rollers 98*a*, 98*b* so as to change the distance or gap or nip between the teeth 100 of the shaping rollers 98*a*, 98*b*. However, even though the distance or gap or nip between the teeth 100 of the shaping rollers 98*a*, 98*b* is changed, every connecting portion is thicker than the peaks and valleys of the generally corrugated web 104, according to this aspect of the invention.

FIG. 11 illustrates a finished multilayered product 112 made in accordance with this aspect of the present invention having a pair of opposed side edges 114, the distance between which defines the width W of the product 112. Similarly, product 112 has a pair of end edges 116, the distance between which defines the length L of the product 112. The product 112 has a middle layer or honeycomb core 118 covered on top and bottom with outer or protective skins or layers 120 (only one being partially shown in FIG. 11).

One of the results of having the connecting portions 110 of the corrugated web 104 thicker than the peaks 106 and valleys 108 of the corrugated web 104 (shown in FIG. 10A) is that the strength of the honeycomb core 118 of product 112 shown in FIG. 11 is the same in the transverse and longitudinal directions. As shown in FIG. 7A, because the thickness of "$T_2$" of the connecting portions 110 of the corrugated web 104 is approximately the same as the thickness of two peaks 106 or valleys 108 of the corrugated web 104 contacting each other, after the process of manufacture is completed, resulting in product 112, the strength of the honeycomb core 118 of product 112 is the same in both the transverse and longitudinal directions.

While I have described several preferred embodiments of the present invention, persons skilled in the art will appreciate changes and modifications which may be made without departing from the spirit of the invention. For example, although one configuration of a cell is illustrated and described, the cells of the present invention may be other configurations, such as cylindrical in shape. Therefore, I intend to be limited only by the scope of the following claims and equivalents thereof.

I claim:

1. A process of making a multilayered product having a honeycomb layer comprising, in any desired order:

passing a web of material between rollers to produce a corrugated web of material having continuous flattened peaks and flattened valleys joined by connecting portions of the web, said flattened peaks and flattened valleys extending in the direction of travel of the web;

cutting portions of the corrugated web;

folding the corrugated web to create a honeycomb core; and applying outer skins to the honeycomb core wherein at least some of said connecting portions of the corrugated web have a thickness greater than the thickness of other of the connecting portions of the corrugated web.

2. The process of claim 1 wherein the step of cutting the continuous corrugations of the corrugated web comprises contacting the corrugated web with two knives.

3. The process of claim 2 wherein the two knives move in opposite directions.

4. A process of making a multilayered product having a honeycomb layer comprising, in any desired order:

moving a planar web of material in a first direction;

passing the web of material between a pair of rollers to produce a corrugated web of material having a corrugated profile with continuous flattened peaks and flattened valleys joined by connecting portions of the web, said flattened peaks and flattened valleys extending in the direction of travel of the web;

cutting the continuous corrugations of the corrugated web;

folding the corrugated web to create a honeycomb core; and applying outer skins to the honeycomb core wherein at least some of said connecting portions of the corrugated web have a thickness greater than the thickness of other of the connecting portions of the corrugated web.

5. The process of claim 4 wherein the step of cutting the continuous corrugations of the corrugated web comprises contacting the corrugated web with two knives.

6. The process of claim 5 wherein the two knives move in opposite directions.

7. A process of making a multilayered product having a honeycomb core comprising, in any desired order:

moving a web of material in a first direction;

passing the web of material between rollers to produce a continuous corrugated web of material having a corrugated profile with continuous flattened peaks and flattened valleys joined by connecting portions of the web, said flattened peaks and flattened valleys extending in the direction of travel of the web;

cutting the continuous corrugations of the continuous corrugated web;

folding the cut continuous corrugated web to create a continuous honeycomb core;

applying outer skins to the continuous honeycomb core to create a three-layered continuous product wherein at least some of said connecting portions of the continuous corrugated web have a thickness greater than the thickness of other of the connecting portions of the continuous corrugated web; and cutting the three-layered continuous product.

8. The process of claim 7 wherein the web of material is unrolled from a roll.

9. The process of claim 7 wherein the step of cutting the continuous corrugations of the continuous corrugated web comprises contacting the continuous corrugated web with two knives.

10. The process of claim 9 wherein the two knives move in opposite directions.

* * * * *